US009376866B2

(12) United States Patent
Nobile et al.

(10) Patent No.: US 9,376,866 B2
(45) Date of Patent: Jun. 28, 2016

(54) HYBRID ROTARY CONE DRILL BIT

(71) Applicant: Varel International Ind., L.P., Carrollton, TX (US)

(72) Inventors: Kyle Nobile, Carrollton, TX (US); Matt Stroever, Carrollton, TX (US); David Michel Harrington, Dallas, TX (US); Karl W. Rose, Carrollton, TX (US)

(73) Assignee: VAREL INTERNATIONAL IND., L.P., Carrollton, TX (US)

( * ) Notice: Subject to any disclaimer, the term of this patent is extended or adjusted under 35 U.S.C. 154(b) by 318 days.

(21) Appl. No.: 13/975,094

(22) Filed: Aug. 23, 2013

(65) Prior Publication Data

US 2015/0053422 A1 Feb. 26, 2015

(51) Int. Cl.

| | |
|---|---|
| ***E21B 10/16*** | (2006.01) |
| ***E21B 10/52*** | (2006.01) |
| ***E21B 29/00*** | (2006.01) |

(52) U.S. Cl.

CPC ..... *E21B 10/52* (2013.01); *E21B 10/16* (2013.01); *E21B 29/00* (2013.01)

(58) Field of Classification Search

CPC ..... E21B 10/16; E21B 10/50; E21B 10/52
See application file for complete search history.

(56) References Cited

U.S. PATENT DOCUMENTS

| | | | | |
|---|---|---|---|---|
| 4,538,691 | A | 9/1985 | Dennis | |
| 5,010,789 | A | 4/1991 | Brett et al. | |
| 5,131,480 | A * | 7/1992 | Lockstedt | E21B 10/50 175/374 |
| 5,311,958 | A | 5/1994 | Isbell et al. | |
| 5,839,526 | A * | 11/1998 | Cisneros | E21B 10/52 175/378 |
| 5,868,213 | A * | 2/1999 | Cisneros | E21B 10/50 175/331 |
| 5,979,571 | A | 11/1999 | Scott et al. | |
| 5,984,007 | A | 11/1999 | Yuan et al. | |
| 6,029,759 | A * | 2/2000 | Sue | E21B 10/16 175/374 |
| 6,116,357 | A * | 9/2000 | Wagoner | E21B 10/003 175/228 |
| 6,296,069 | B1 | 10/2001 | Lamine et al. | |
| 7,958,940 | B2 | 6/2011 | Jameson | |
| 8,162,081 | B2 | 4/2012 | Ballard et al. | |
| 8,517,123 | B2 | 8/2013 | Reese | |
| 8,561,729 | B2 | 10/2013 | King et al. | |
| 2003/0159543 | A1 * | 8/2003 | Griffo | E21B 10/50 76/108.2 |
| 2007/0079995 | A1 | 4/2007 | McClain et al. | |
| 2007/0144789 | A1 | 6/2007 | Johnson et al. | |

(Continued)

FOREIGN PATENT DOCUMENTS

| | | | |
|---|---|---|---|
| CN | 203022637 | U | 6/2013 |
| RU | 1803523 | C | 3/1993 |
| RU | 20924 | U1 | 12/2001 |
| WO | WO-2013017859 | A2 | 2/2013 |

OTHER PUBLICATIONS

HugheSet(r) Series Tri-Cone Reamers specification sheet, Type RG-3, 83/4" RG-3 Reamer, Hughes Tool Company, Catalog 23 (2 pages).

(Continued)

*Primary Examiner* — Robert E Fuller
*Assistant Examiner* — Steven MacDonald

(57) ABSTRACT

A hybrid rotary cone drill bit includes a plurality of legs. A bearing shaft extends from each leg, and a rotary cone is rotationally coupled to each bearing shaft. At least one rotary cone includes a nose row of cutting structures, an inner row of cutting structures, and a gage row of cutting structures. The nose row and the inner row of cutting structures are formed of milled teeth. The gage row of cutting structures is formed of cutter inserts.

14 Claims, 5 Drawing Sheets

(56) References Cited

U.S. PATENT DOCUMENTS

| | | | | |
|---|---|---|---|---|
| 2009/0126998 | A1* | 5/2009 | Zahradnik | E21B 10/14 175/57 |
| 2010/0038146 | A1* | 2/2010 | Felderhoff | E21B 10/50 175/374 |
| 2010/0155149 | A1 | 6/2010 | Keshavan et al. | |
| 2010/0288561 | A1* | 11/2010 | Zahradnik | E21B 10/14 175/336 |
| 2013/0068539 | A1* | 3/2013 | Vempati | E21B 10/5735 175/434 |
| 2015/0218935 | A1 | 8/2015 | Pelletier et al. | |

OTHER PUBLICATIONS

Hughes Tool Company, Oil Tool Division, Houston, TX, "Hughes Heel-Pac Makes Undergage Hole Obsolete," Jun. 24, 1996 (2 pages).
PCT Search Report and Written Opinion for PCT/US2014/046460 dated Oct. 16, 2014 (7 pages).
Korneev K. E. , et al: Burovye dolota. Moskva, lzdatelstvo "Nedra," 1965, p. 69, 70, 72, 73, drawings 76, 77.
Korneev K. E. , et al: Burovye dolota. Moskva, Izdatelstvo "Nedra," 1965, p. 69, 70, 72, 73, drawings 76,77 [Translation With Certificate of Accuracy].

* cited by examiner

HYBRID ROTARY CONE DRILL BIT

TECHNICAL FIELD

The present invention relates generally to bits for drilling a wellbore, and more particularly to a hybrid rotary cone drill bit for use in conditioning a wellbore and drilling out hydraulic fracture equipment (e.g. frac plugs) or bridge plugs.

BACKGROUND

A roller cone rock bit is a cutting tool used in oil, gas, and mining fields to break through earth formations to shape a wellbore. In shaping the wellbore, the roller cone bit drills through different geological materials making up different rock formations. Although the drill bit encounters different formations at different depths in drilling through rock, generally speaking all parts of the drill bit are drilling the same type of rock formation at the same time.

In hydraulic fracturing operations, a frac plug is secured to a casing that lines the borehole. The frac plug is something of a disposable tool because after the frac plug has performed its function, it is drilled out using a roller cone rock bit manufactured to International Association of Drilling Contractors (IADC) standards, and the drilled out pieces of the plug are flushed up the wellbore by the drilling mud. A frac plug is a generally cylindrical component formed of different materials disposed at different radial positions moving from a generally hollow center. In contrast to drilling through rock formations, when drilling out a frac plug, the drill bit simultaneously drills through different materials. The different materials create different penetration efficiencies and wear characteristics on different parts of the bit.

Reference is made to U.S. Pat. No. 5,131,480 to Lockstedt (the disclosure of which is incorporated by reference), which discloses a milled tooth rotary cone rock bit where a heel row of each cone is relieved and tungsten carbide chisel inserts are inserted in the relieved heel row.

The heel row inserts cooperate with the gage row milled teeth and progressively cut more of the gage row of the bore hole as the gage row milled teeth wear.

SUMMARY

In an embodiment, a hybrid rotary cone drill bit includes a plurality of legs. A bearing shaft extends from each leg, and a rotary cone is rotationally coupled to each bearing shaft. At least one rotary cone includes a nose row of cutting structures, an inner row of cutting structures, and a gage row of cutting structures. The nose row and the inner row of cutting structures include milled teeth. The gage row of cutting structures includes cutter inserts.

In certain embodiments, the cutter inserts are tungsten carbide inserts and the milled teeth are formed of steel. The cutter inserts may be conical-shaped or chisel-shaped.

The hybrid rotary cone drill bit of the present disclosure is employed to drill out different materials of a plug simultaneously. The location of the cutter inserts and the milled teeth on the rotary cones allows the different materials of the plug to be effectively drilled out. Specifically, the relatively harder material of a plug slip disposed on an outer diameter of the plug is effectively drilled out by the cutter inserts disposed on an outer diameter of the bit, while the relatively softer material of the plug body is effectively drilled out by milled teeth disposed radially inward of the cutter inserts.

Other aspects, features, and advantages will become apparent from the following detailed description when taken in conjunction with the accompanying drawings, which are a part of this disclosure and which illustrate, by way of example, principles of the inventions disclosed.

BRIEF DESCRIPTION OF THE DRAWINGS

For a more complete understanding of the present invention and the advantages thereof, reference is now made to the following brief description, taken in connection with the accompanying drawings and detailed description, wherein like reference numerals represent like parts, in which.

DETAILED DESCRIPTION OF THE DRAWINGS

Figure 1:
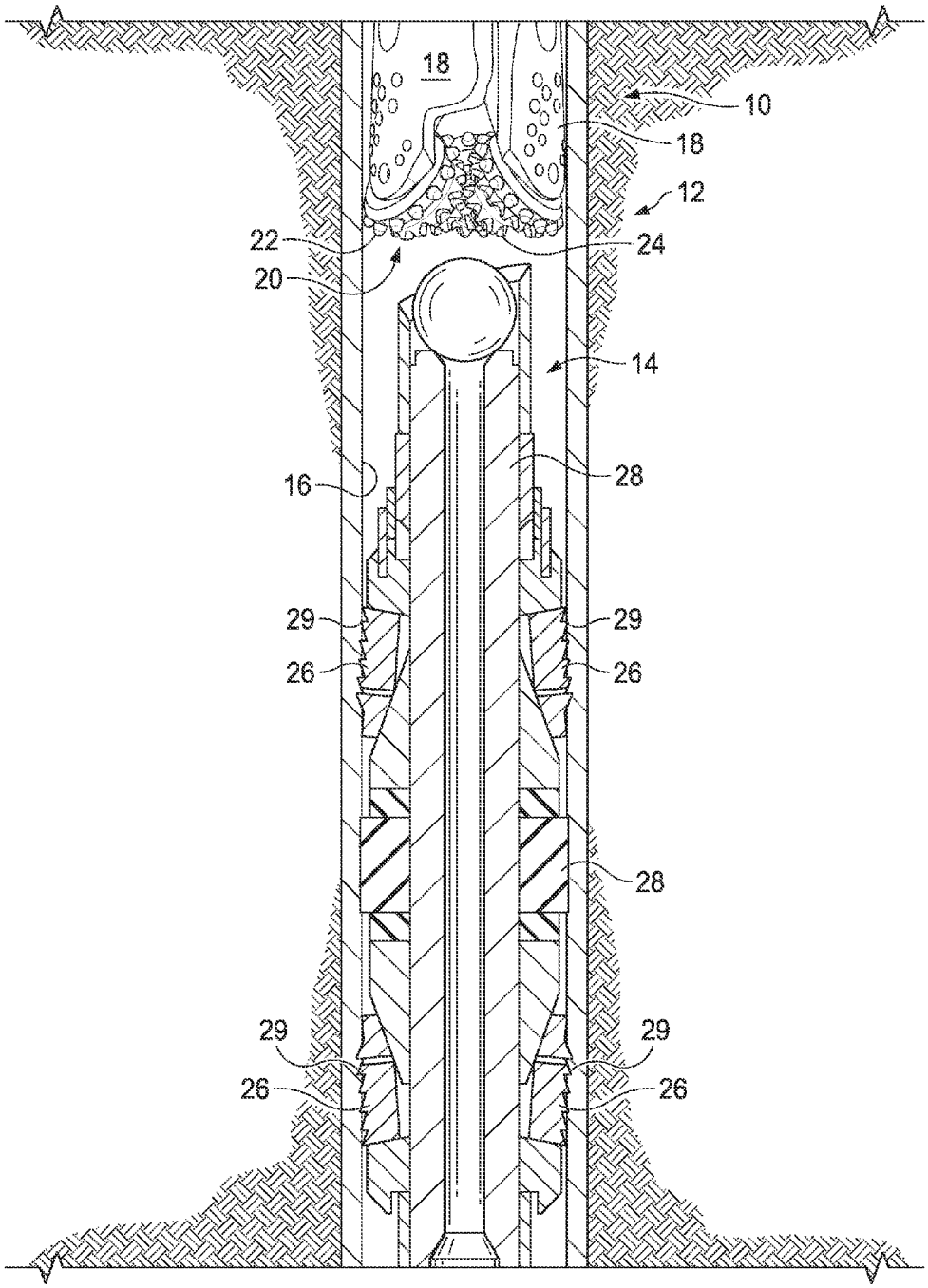
FIG. 1 illustrates a hybrid rotary cone drill bit disposed in a drill out position directly above a cross section of a frac plug set in a borehole.

Reference is now made to FIG. 1, which shows a hybrid drill bit 10 or more specifically a hybrid rotary cone drill bit 10. The hybrid rotary cone drill bit 10 is illustrated in a borehole or wellbore 12 lined with a metal casing 16. The bit 10 is shown in a drill out position above a cross section of a casing plug or plug 14. The hybrid drill bit 10 includes three legs 18 (two shown) that depend from a bit body (not shown). As described in more detail below, each of the legs 18 supports a rotary cone 20. Each of the rotary cones 20 includes two different types of cutting structures. The cutting structures closest to the casing 16 in the wellbore 12 are cutter inserts 22, for example, tungsten carbide inserts. The cutting structures towards the center of the wellbore 12 are milled teeth 24. The cutter inserts 22 are conical-shaped but may be dome-shaped, chisel-shaped, double conical-shaped, ovoid-shaped, or any other shape suitable for drilling out a casing plug 14.

The hybrid drill bit 10 is configured to drill out the entirety of a borehole and/or a frac plug secured within a borehole. Thus, the hybrid drill bit 10 is configured to drill out either rock formation or portions of a frac plug from the centerline of the borehole and extending to the full radius of the borehole. The hybrid drill bit 10 differs from a reamer in that a reamer is not configured to drill out a central portion of a borehole proximate the centerline. Rather, a reamer is configured to ream a hole that has already been at least partially formed.

In certain borehole operations, such as hydraulic fracturing or fracking, a plug 14, such as a frac plug, is used to isolate a portion of a wellbore 12 to be fracked. The plug 14 acts as a one-way valve and allows a specific section of the borehole to be isolated and pressurized for the hydraulic fracking operation. After the plug 14 has performed its function, it is drilled out in a drill out operation using the hybrid rotary cone drill bit 10 according to the teachings of the present disclosure. In a drill out operation, the hybrid rotary cone drill bit 10 is attached to a drill string and is rotated such that its cutting elements crush, rip, and break apart the plug 14. Drilling fluid pumped through the bit 10 flushes the pieces of the plug 14 back to the surface. Plugs other than frac plugs may be secured in a borehole and may be drilled out with a hybrid rotary cone drill bit 10 according to the teachings of the present disclosure. For example, the hybrid rotary cone drill bit 10 may be used to drill out bridge plugs and other types of plugs that engage a casing 16.

In preparation for fracking, the plug 14 is positioned at the desired location in the borehole 12 such that an outer diameter portion of the plug 14 grips the casing 16 and secures or sets the plug 14 in position. Once set, the plug 14 will withstand pressurization of the zone in the borehole without moving or slipping. To set the plug 14, a slip 26 that is generally in the form of a ring surrounding a portion of a plug body 28 is caused to engage the casing 16 and create a type of seal. For purposes of this disclosure, the plug body 28 includes any portion of the plug not formed of relatively harder material that is engaged with the casing 16 to set the plug in position and create a seal. Although the plug body 28 is primarily disposed radially internal to the slip 26, some portions of the plug body 28 may be disposed above or below and aligned with the slips 26.

In the embodiment illustrated in FIG. 1, an upper and a lower slip 26 are shown. The slips 26 each include a plurality of ridges 29 that bite into the casing to provide a robust grip. The slips 26 expand and may partially fracture such that some of the slips 26 embed into the metal casing 16. To maintain the grip of the plug 14 under high pressures, the slip 26 is generally formed from a hard material. In certain plugs 14, the slip 26 is formed from cast iron. Once set, the slip 26 occupies a space between the casing 16 and the plug body 28, which may be up to an inch inside the diameter of the casing. For example, a casing 16 of a borehole may have a diameter of approximately twelve inches and the slip 26 may have an outer diameter of approximately twelve inches and an inner diameter of approximately ten inches.

In certain embodiments, the slip 26 may include tungsten carbide or ceramic inserts that embed into the casing 16 for a better grip. A plug including such inserts is disclosed in U.S. Pat. No. 5,984,007 to Yuan (the disclosure of which is incorporated by reference). In contrast to the very hard material of the slip 26, the plug body 28 is generally formed of softer material than the slip 26 and/or any inserts that are included in the slip 26. For example, the plug body 28 is often formed of a composite material, a thermoplastic, or a softer metal, such as brass.

Because the plug 14 includes relatively softer materials in its inner portions and relatively harder materials in its outer portions, during drill out the hybrid rotary cone drill bit 10 simultaneously contacts and breaks apart both relatively harder and relatively softer materials. As such, during the drill out using the hybrid bit 10, the cutter inserts 22 engage the slip 26 and/or the plug inserts that are adjacent, contacting, or embedded into the casing 16. This is because the cutter inserts 22 are disposed on the outer diameter of the bit 10, which in operation are closest to the casing 16. For example, the cutter inserts 22 may be disposed on the outer one inch diameter of the cutting face of the bit 10. Thus, a hybrid rotary cone drill bit 10 with a face defining a twelve inch outer diameter may have milled teeth from its center to an approximately 10 inch diameter while the outer one inch radius (two inch diameter) of the face is where the cutter inserts 22 are disposed.

The softer bit body 28 is drilled out by the milled teeth 24, but the milled teeth are generally not subjected to the hard material of the slip 26, which increases the overall durability of the bit 10. The milled teeth 24 are more aggressive, efficient, and better suited for penetrating, gripping, and cutting the softer material of the plug body 28. In contrast, the cutter inserts 22 are less efficient in cutting and ripping the material of the plug body 28. Moreover, if the cutter inserts 22 are used to drill out the plug body 28, the steel substrate of the rotary cone 20 is subject to wear, which often results in expensive cutter inserts separating from the rotary cone 20 and being lost in the borehole.

The cutter inserts 22 are typically formed of very hard material, such as tungsten carbide. The cutter inserts 22 may alternatively be other very hard material incorporated into a cutting structure, such as a polycrystalline diamond compact, an impregnated diamond segment, a polycrystalline cubic boron nitride compact, or the cutter inserts 22 may be formed of any of the material in the family of ceramic materials. The hard material incorporated into the cutter inserts 22 does not wear as fast as the steel substrate when it drills through or otherwise contacts the substantially equally hard material of the slip 26 and or slip inserts. Thus, the cutter inserts 22 wear less than the milled teeth 24 when drilling out the hard material of the slip 26 and or slip inserts of the plug 14.

Figure 2A:
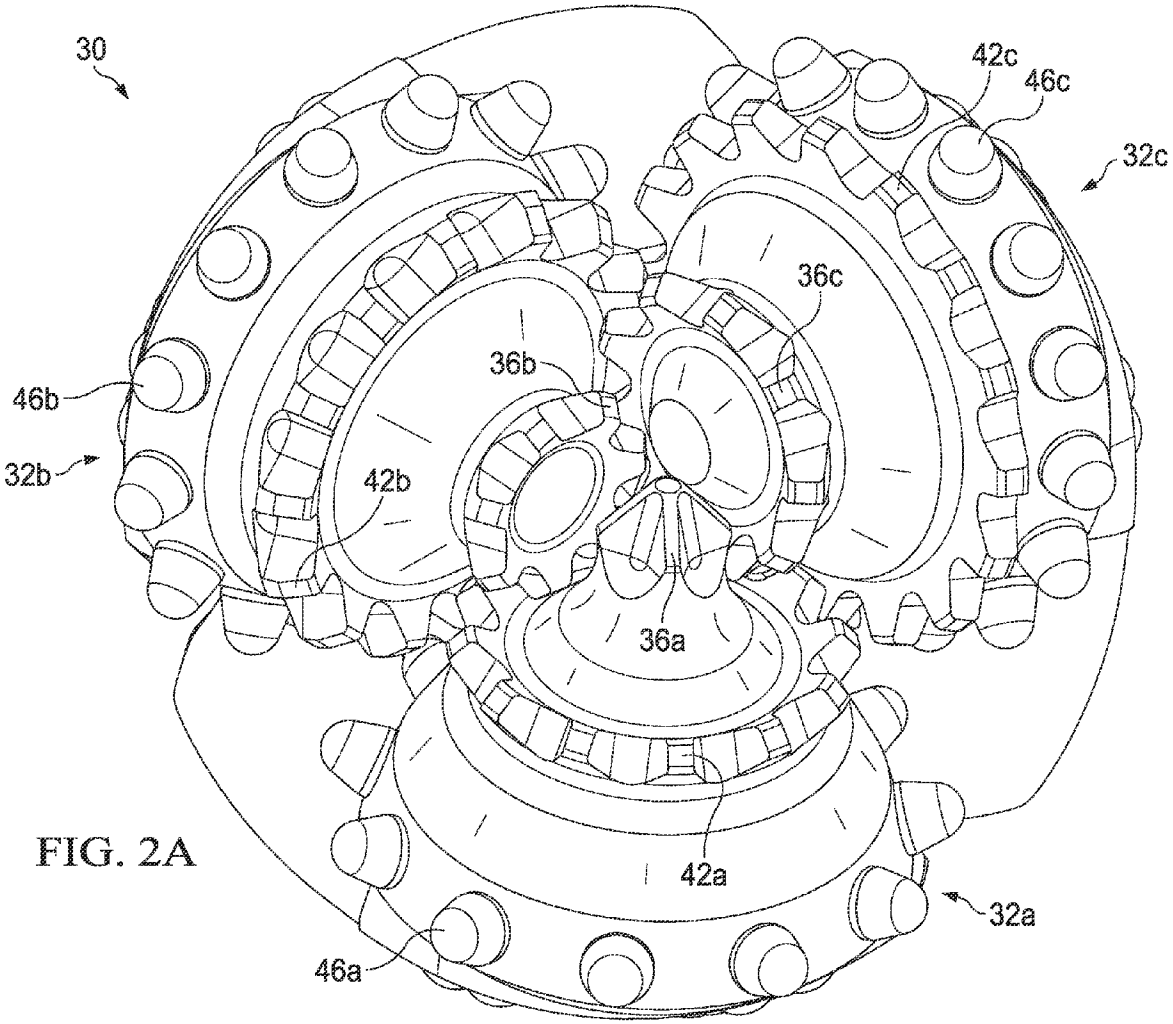
FIG. 2A illustrates a face of a hybrid rotary cone drill bit according to the teachings of the present disclosure.
Figure 2B:
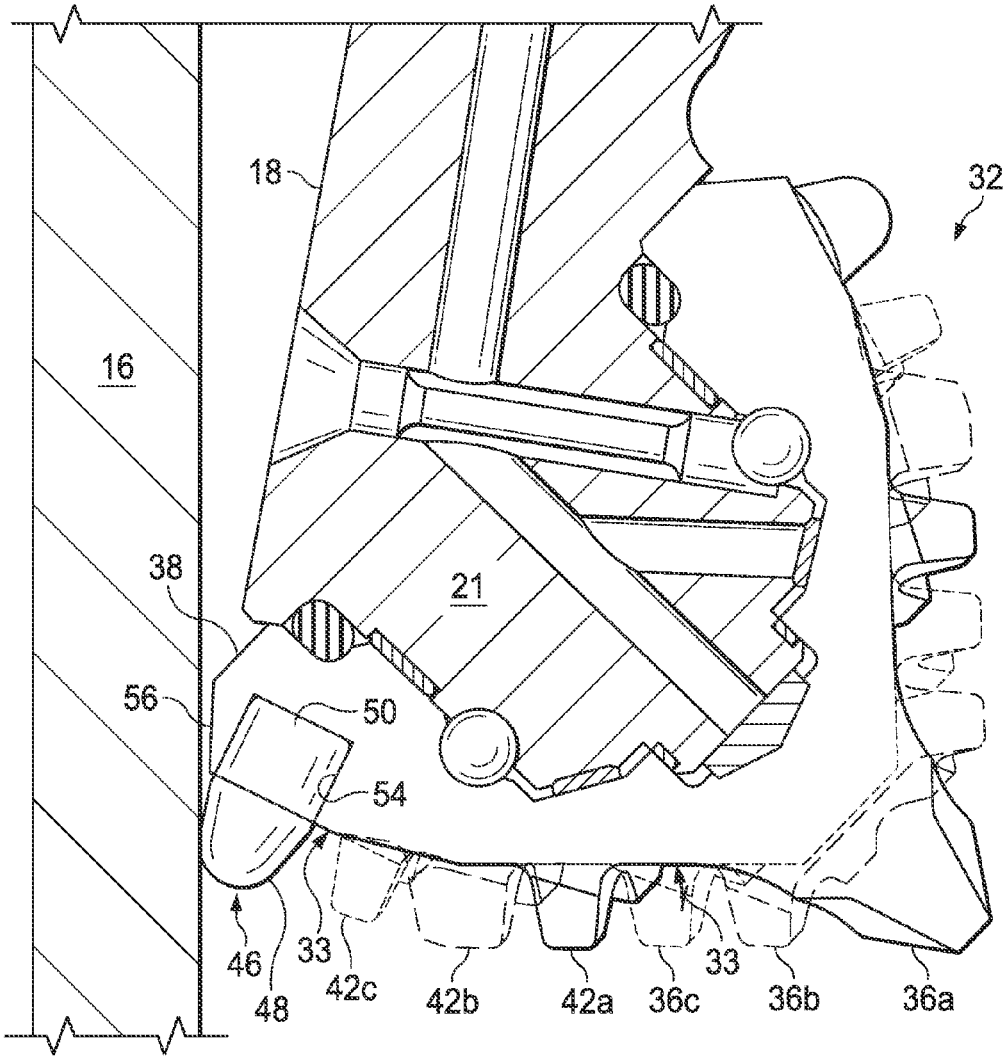
FIG. 2B illustrates a cross section with rotational projections showing the position of milled teeth and cutter inserts in a borehole according to the teachings of the present disclosure.

Reference is made to FIGS. 2A and 2B, which illustrate in more detail the rotary cones 20 of the hybrid drill bit 10 according to the teachings of the present disclosure. FIG. 2A shows the face 30 of the hybrid rotary cone drill bit. FIG. 2B is a cross-section taken through one of the rotary cones shown in FIG. 2A. In addition, FIG. 2B illustrates a rotational projection of the position of the cutting elements of each of the three rotary cones as the bit rotates in the borehole. FIG. 2B shows a bearing shaft 21 extending from the leg 18 of the bit. Each rotary cone is rotatably mounted to a bearing shaft 21.

FIG. 2A shows rotary cone one 32*a*, rotary cone two 32*b*, and rotary cone three 32*c* (collectively illustrated as rotary cone 32 in FIG. 2B). Rotary cones are also referred to as roller cones. Each of the rotary cones 32*a*, 32*b*, 32*c* defines a generally conical surface 33 (see FIG. 2B) and includes two different cutting elements extending from the generally conical surface 33. For example, rotary cone one 32*a* includes a nose row, which is disposed in the centermost area of the drill bit and is formed of a plurality of milled teeth 36*a*. As previously discussed, the milled teeth 36*a* are milled into the steel of the substrate of the rotary cone 32*a* and are aggressive cutting structures. The bit substrate also may be formed from a matrix metal or any other material suitable for earth boring drill bits.

According to the teachings of the present disclosure, the nose row milled teeth 36*a* are disposed in a central portion of the bit to drill through the corresponding softer material center portion of a plug, referred to as the plug body. The nose row milled teeth 36*a* efficiently drill through this softer material at a higher rate of penetration than other types of cutting structures, including cutter inserts 22. Each of rotary cones two and three also include nose rows of milled teeth 36*b*, 36*c*. The relative drilling positions among the nose rows of milled teeth are shown in FIG. 2B.

Disposed from the nose row milled teeth toward a base 38 of the rotary cone 32 is an inner row of cutting structures. The cutting structures forming the inner row are milled teeth 42*a* formed similarly to the nose row milled teeth 36*a*. Each of rotary cones one, two, and three have one inner row of milled teeth 42*a*, 42*b*, 42*c*. Similar to the nose row milled teeth 36*a*, 36*b*, 36*c*, the inner row milled teeth 42*a*, 42*b*, 42*c* are also disposed to drill through the inner portion of the plug 14 or plug body 28, which generally is formed from softer materials, such as composites, thermoplastics, or softer metals. The relative drilling positions among the inner rows of milled teeth 42*a*, 42*b*, 42*c* for each rotary cone 32*a*, 32*b*, 32*c* are illustrated in FIG. 2B. Alternate embodiments of a hybrid rotary cone drill bit according to the teachings of the present disclosure may include more than one inner row of milled teeth. For example, a larger drill bit will have larger rotary cones, which will tend to have one or more additional inner rows of milled teeth to drill out larger diameter plugs.

A gage row of cutter inserts 46 is disposed closest to the base of the rotary cone 32. The gage row of cutter inserts 46 extend from the generally conical surface 33 of the rotary cone 32. Each of rotary cones one, two, and three includes gage rows of cutter inserts 46*a*, 46*b*, 46*c*. In the embodiment shown in FIGS. 2A and 2B, the cutter inserts 46 are conical-shaped. In addition, the cutter inserts 46 of each of the three cones 32 are generally aligned during rotation, such that the cutter inserts 46 of all three cones 32*a*, 32*b*, 32*c* are illustrated by a single cutter insert projection in FIG. 2B. In an alternate embodiment, the gage row of the rotary cone 32 may include both milled teeth and cutter inserts. The milled teeth may be slightly internally offset and intermeshed with the cutter inserts or the milled teeth may be interspersed within the gage row of cutter inserts.

As shown in FIG. 2B, the cutter inserts 46 are disposed closest to the casing 16 during drill out. As such, when drilling out a plug, the cutter inserts 46 will drill out the outermost diameter portion of the plug including those portions of the plug that are embedded into or otherwise securing the plug to the casing 16. As previously described, the outermost diameter portion of the plug 14 is referred to as the slip 26 and is generally formed from hard material that is more likely to wear the steel of the rotary cones 32 than the softer plug body 28. Thus, the cutter inserts 46 are better suited to drill out such hardened material, such as a cast iron slip and/or or tungsten carbide or ceramic slip inserts.

As seen in the cross section of FIG. 2B, the cutter inserts 46 include a cutting portion 48, which is disposed above the generally conical surface 33 of the rotary cone 32 and a lower base portion 50, which is disposed below the generally conical surface 33 of the rotary cone. A hole or socket 54 is formed in the generally conical surface 33 of the rotary cone 32, either by casting or machining, that receives the lower base portion 50 of the cutter insert 46 in a press or interference-type fit. The lower base portion 50 may be welded or brazed into the socket 54. In addition, an adhesive may be used to secure the lower base portion 50 into the socket 54. The cutter insert 46 illustrated is conical-shaped, but alternatively the cutter insert may be chisel-shaped or any other suitable shape for the cutting portion 48 of the cutter insert 46.

Disposed between the gage row 44 and the base 38 is a heel 56 of the rotary cone 32. The heel 56 and the base 38 are not considered part of the generally conical surface 33 of the rotary cone 32. There are generally no cutting elements, milled tooth or cutter inserts, on the base 38 or the heel 56 of the rotary cone 32.

The milled teeth 36*a*, 36*b*, 36*c* of the nose rows (especially the nose row milled teeth 36*a* of cone one 32*a*) provide a penetrating cutting structure to drill out the center portion of the plug. In addition, the tooth profile of the milled teeth is better suited to penetrate the softer material of the bit body. Together, these characteristics of the milled teeth allow the cutter to penetrate and "chew" up the softer material of the plug body while simultaneously the harder cutter inserts 46, for example tungsten carbide inserts, dislodge the slip 26 from the casing and break the slip apart into chunks to be flushed up the borehole.

Figure 3A:
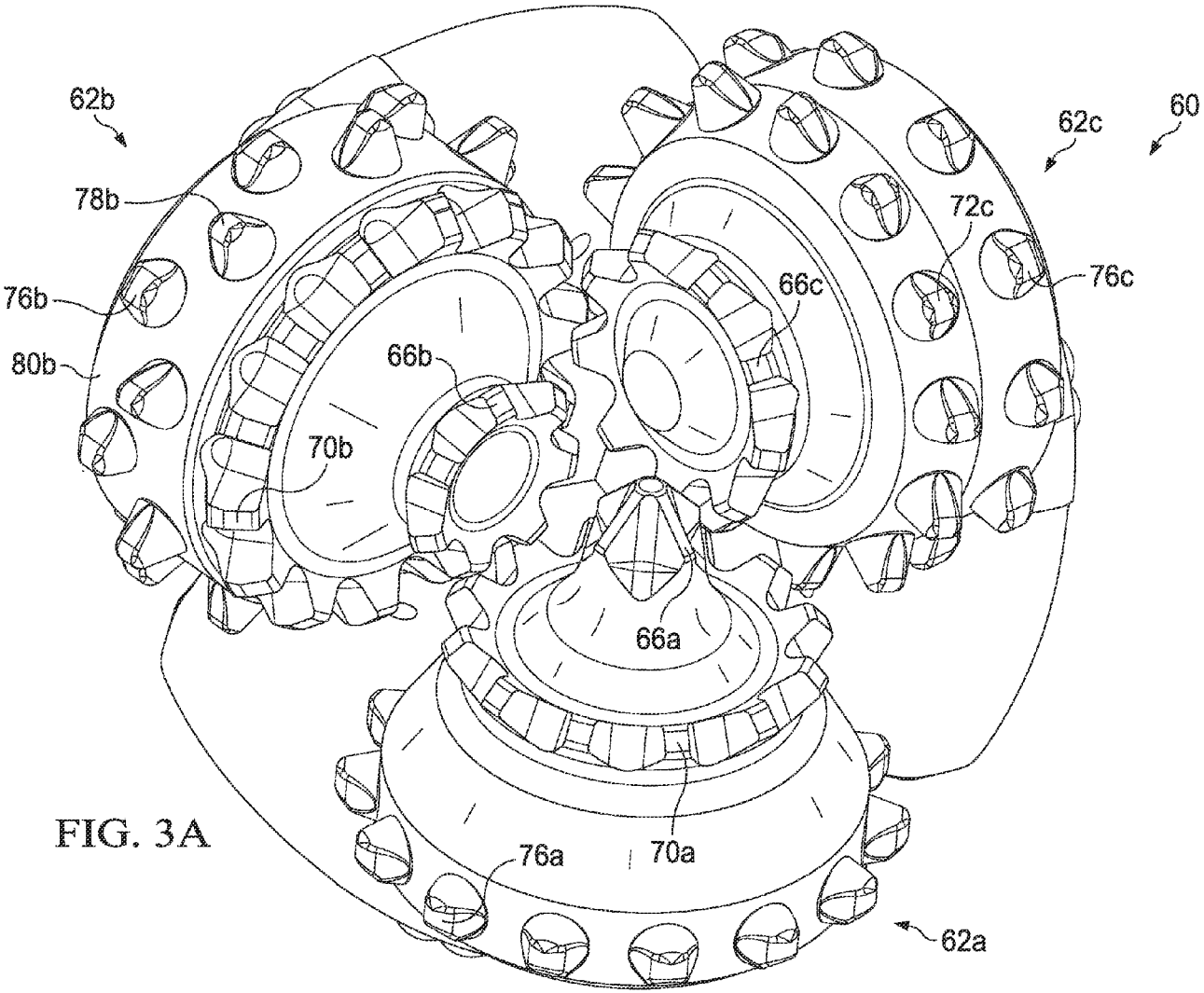
FIG. 3A illustrates a face of an alternate embodiment of a hybrid rotary cone drill bit according to the teachings of the present disclosure.
Figure 3B:
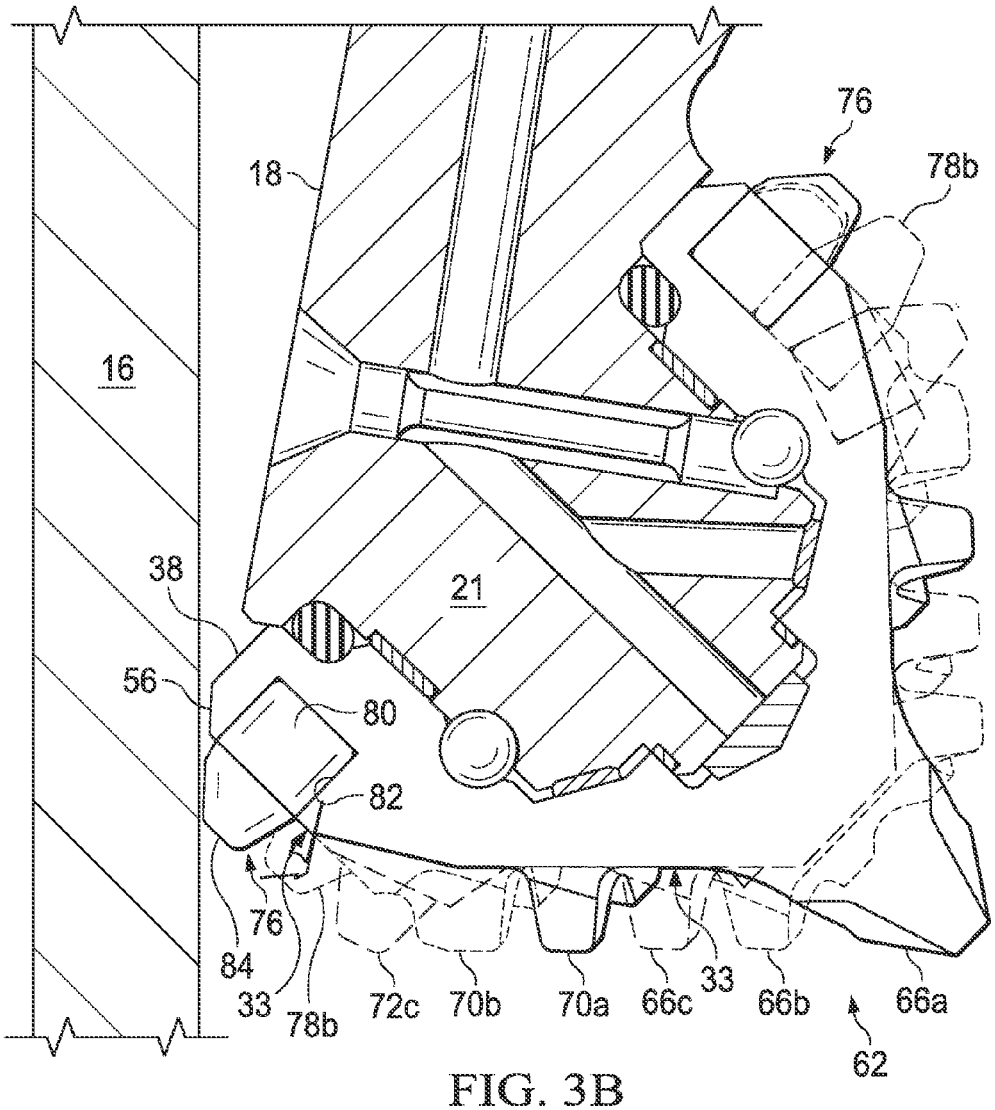
FIG. 3B illustrates a cross section with rotational projections showing the position of milled teeth and cutter inserts in a borehole according to the teachings of an alternate embodiment of the present disclosure.

Reference is now made to FIGS. 3A and 3B, which illustrate an alternate embodiment of a hybrid rotary cone drill bit according to the teachings of the present disclosure. FIG. 3A shows the face 60 of the hybrid rotary cone drill bit. FIG. 3B illustrates a cross-section taken through one of the rotary cones shown in FIG. 3A. In addition, FIG. 3B illustrates a rotational projection of the position of the cutting elements of each of the three rotary cones 62 as the bit rotates.

Similar to the embodiment of FIGS. 2A and 2B, each of the rotary cones 62 includes a nose row of milled teeth 66*a*, 66*b*, 66*c*. Also, rotary cones one and two 62*a*, 62*b* each include an inner row of milled teeth 70*a*, 70*b*. An inner row 68*c* of rotary cone three 62*c* includes a row of cutter inserts 72*c*. However, in an alternate embodiment, all three of the rotary cones 62 may each include an inner row of milled teeth. Also, as discussed with respect to the embodiment shown in FIGS. 2A and 2B, the cones 62 may include more than one inner row of milled teeth.

Each of the three cones 62 include a gage row of cutter inserts 76*a*, 76*b*, 76*c* (represented by reference number 76 in FIG. 3B) configured to drill out and break apart the harder material of the slip 26 of the plug 14 or slip inserts that may be embedded in the casing 16. The gage row of rotary cone two 62*b* includes an adjacent-to-gage row of cutter inserts 78*b* intermeshed with gage row of cutter inserts 76*b*. The adjacent-to-gage row cutter inserts 78*b* are secured into recesses formed in the same land 80*b* as the gage row cutter inserts 76*b*. The degree of intermeshing is shown in FIG. 3B. Other embodiments of the present disclosure may include adjacent-to-gage row cutter inserts on cones one and/or three in addition to rotary cone two. The adjacent-to-gage row cutter inserts 78*b* are used to break apart larger slips 26 and protect the milled teeth from contacting and being worn by the harder material of the slip.

As shown in FIG. 3B, a base portion 80 of the cutter inserts of inner row 72*c*, gage rows 74, and adjacent-to-gage row 78*b* is secured into a socket 82 formed in the rotary cone; a cutting portion 84 extends beyond the outer generally conical surface 33 of the rotary cone, as described above with respect to FIG. 2B. The gage row cutter inserts 76 shown are gage-chisel-shaped inserts. However, any suitable cutter insert including chisel-shaped, dome-shaped, conical-shaped, double conical-shaped, ovoid-shaped, and the like may be used in the hybrid rotary cone drill bit according to the teachings of the present disclosure.

The foregoing describes only some embodiments of the invention(s), and alterations, modifications, additions and/or changes can be made thereto without departing from the scope and spirit of the disclosed embodiments, the embodiments being illustrative and not restrictive.

What is claimed is:

1. A rotary cone drill bit, comprising:

a plurality of legs;

a bearing shaft extending from each leg; and first and second rotary cones, each rotary cone rotatably mounted to a respective bearing shaft, wherein:

each rotary cone defines a generally conical surface, each rotary cone has a nose row of cutting structures, an inner row of cutting structures, and a gage row of cutting structures, each cutting structure extends from the respective generally conical surface, the nose row of the cutting structures of each rotary cone comprises milled teeth, the inner row of the cutting structures of the first rotary cone comprises milled teeth, the inner row of the cutting structures of the second rotary cone consists of cutter inserts, the gage row of cutting structures of each rotary cone consists of cutter inserts, and each cutter insert includes a cutting portion disposed above the respective generally conical surface and a lower base portion disposed below the respective generally conical surface.

2. The rotary cone drill bit of claim 1, wherein:

the rotary cone drill bit further comprises a third rotary cone, and the inner row of the cutting structures of the third rotary cone comprises milled teeth.

3. The rotary cone drill bit of claim 2, wherein:

the nose row of the first rotary cone is disposed closer to a center rotational axis of the drill bit than the nose row of the third rotary cone, and the nose row of the third rotary cone is disposed closer to the center rotational axis than the nose row of the second rotary cone.

4. The rotary cone drill bit of claim 3, wherein the third rotary cone includes an adjacent to gage row of cutter inserts intermeshed and extending from a same land as the gage row of cutter inserts.

5. The rotary cone drill bit of claim 1, wherein each of the milled teeth is formed of steel.

6. The rotary cone drill bit of claim 1, wherein the cutter inserts are tungsten carbide cutter inserts.

7. The rotary cone drill bit of claim 1, wherein the cutter inserts are selected from a group consisting of: polycrystalline diamond compact cutter inserts, impregnated diamond segment cutter inserts, polycrystalline cubic boron nitride compact cutter inserts, and ceramic cutter inserts.

8. The rotary cone drill bit of claim 1, wherein the cutter inserts are each interference fit into respective sockets formed in each rotary cone.

9. The rotary cone drill bit of claim 1, wherein the cutter inserts are each brazed into respective sockets formed in each rotary cone.

10. The rotary cone drill bit of claim 1, wherein the cutter inserts are each welded into respective sockets formed in each rotary cone.

11. The rotary cone drill bit of claim 1 wherein the cutter inserts are each adhered using an adhesive into respective sockets formed in each rotary cone.

12. The rotary cone drill bit of claim 1, wherein each of the cutter inserts is conical-shaped.

13. The rotary cone drill bit of claim 1, wherein each of the cutter inserts is chisel-shaped.

14. The rotary cone drill bit of claim 1, wherein each of the rotary cones includes a base surface and a heel surface, the heel surface being axially disposed between the base surface and the gage row of cutter inserts, the heel surface not supporting a cutting structure.

* * * * *